US005216991A

United States Patent [19]

Iida et al.

[11] Patent Number: 5,216,991

[45] Date of Patent: Jun. 8, 1993

[54] INTERNAL COMBUSTION ENGINE CONTROLLER

[75] Inventors: Hisashi Iida, Aichi; Shigenori Isomura, Kariya; Junya Morikawa, Kasugai, all of Japan

[73] Assignee: Nippondenso Co., Ltd., Kariya, Japan

[21] Appl. No.: 937,165

[22] Filed: Aug. 31, 1992

[30] Foreign Application Priority Data

Sep. 2, 1991 [JP] Japan ..... 3-221900
Jul. 14, 1992 [JP] Japan ..... 4-186562

[51] Int. Cl.[5] ..... F02M 3/00; F02M 33/02

[52] U.S. Cl. ..... 123/339; 123/520; 123/518; 123/519

[58] Field of Search ..... 123/339, 518, 519, 520

[56] References Cited

U.S. PATENT DOCUMENTS

| | | | |
|---|---|---|---|
| 4,741,318 | 5/1988 | Kortge et al. | 123/520 |
| 4,945,885 | 8/1990 | Gooze et al. | 123/520 |
| 4,951,627 | 8/1990 | Wataraba et al. | 123/339 |
| 5,042,448 | 8/1991 | Cook et al. | 123/339 |
| 5,069,188 | 12/1991 | Cook | 123/520 |
| 5,136,997 | 8/1992 | Takahashi et al. | 123/339 |
| 5,143,040 | 9/1992 | Okawa et al. | 123/520 |

FOREIGN PATENT DOCUMENTS

| | | |
|---|---|---|
| 2-130255 | 5/1990 | Japan . |
| 2-136558 | 5/1990 | Japan . |

*Primary Examiner*—Raymond A. Nelli
*Attorney, Agent, or Firm*—Cushman, Darby & Cushman

[57] ABSTRACT

An internal combustion engine in which a purge control valve is provided in a fuel vapor supply passage connecting a canister and an intake pipe of the internal combustion engine, the opening degree of the purge control valve is regulated by a purge flow rate control unit depending on operating condition of the internal combustion engine, and the opening degree of a rotational speed control valve is regulated to adjust an amount of intake air into the internal combustion engine, thereby changing a rotational speed of the internal combustion engine. While the internal combustion engine is idling in such a condition that the air/fuel ratio of a gas mixture supplied to the internal combustion engine is controlled to be held constant and the opening degree of the rotational speed control valve is regulated so that the rotational speed of the internal combustion engine reaches a target value, a controller operates to forcibly change the opening degree of the purge control valve from a first set opening degree to a second set opening degree, and determine the presence or absence of an abnormality in supply of fuel vapor to the intake pipe of the internal combustion engine through the supply passage and the purge control valve based on a change in the opening degree of the rotational speed control valve resulting at that time.

8 Claims, 15 Drawing Sheets

1
310
0.95 ≦ FAF ≦ 1.05 ?
NO
YES
311
650 ≦ NE ≦ 750 rpm ?
NO
YES
312
HAS 5 sec OR MORE ELAPSED AFTER FULLY CLOSING PURGE CONTROL VALVE ?
NO
YES
314
STORE OPENING DEGREE Q1 OF ROTATIONAL SPEED CONTROL VALVE
313
F1 ← 1
7
F1 ← 0
315
3
DUTY OF PURGE CONTRO VALVE Pi ← Pi-1 + 0.2 %
316
2
317
0.95 ≦ FAF ≦ 1.05 ?
NO
YES
318
650 ≦ NE ≦ 750 rpm ?
NO
YES
319
HAS 500ms OR MORE ELAPSED AFTER CHANGE OF OPENING DEGREE OF PURGE CONTROL VALVE ?
NO
YES
320
F2 ← 1
6
8

INTERNAL COMBUSTION ENGINE CONTROLLER

BACKGROUND OF THE INVENTION

1. Field of the Invention

The present invention relates to an internal combustion engine controller, and more particularly to an internal combustion engine controller provided with a unit for preventing diffusion of fuel vapor produced in a fuel supply system of automobiles.

2. Description of the Related Art

A self-diagnosis device for use in a unit for preventing diffusion of fuel vapor is disclosed in Japanese Patent Laid-Open No. 2-130255. The disclosed device has a pressure sensor disposed in a supply passage connecting a canister and an intake pipe. Based on the result detected by the pressure sensor, the device detects such an abnormality in fuel supply that no fuel vapor is supplied to the intake pipe.

As disclosed in Japanese Patent Laid-Open No. 2-136558, there is also known a device designed to detect the generation of fuel vapor by measuring the pressure in a fuel tank, open and close a purge control valve upon the generation of fuel vapor, and detect an abnormality based on a deviation of the air/fuel ratio at that time.

With the device of the above-cited Japanese Patent Laid-Open No. 2-130255, however, the pressure detection by the pressure sensor disposed in the supply passage enables an extreme abnormality such as disconnection or clogging of pipes to be detected, but has difficulties in detecting a reduction in the passage area due to dust deposits in pipes, a lowering of the flow rate in the purge control valve due to malfunction of a valve body of the purge control valve, suction of the open air due to cracks of pipes or other causes, etc. Such a change in flow rate characteristics (or such a lowering of the flow rate purged) would result in that a sufficient supply ability (purging ability) of the fuel vapor from the canister can no longer be ensured. This will bring activated charcoal in the canister into a broken state sooner or later (beyond the adsorption capacity), causing the fuel vapor to be discharged through a hole of the canister open to the atmosphere.

With the device of the above-cited Japanese Patent Laid-Open No. 2-136558, the deviation of the air/fuel ratio is largely fluctuated depending on the amount of air remaining in a fuel tank. For example, when the amount of fuel in the fuel tank is large, even with a small amount of the fuel vapor the pressure is so raised as to satisfy conditions for detecting an abnormality. In this case, since the fuel vapor is lean and the air/fuel ratio remains unchanged, the fuel vapor diffusion preventing unit, even though it is under normal condition, is judged to be abnormal and false detection results. Also, at the time fuel begins to vaporize, the air purged into an intake pipe becomes so lean that the air/fuel ratio is not changed even when the purge control valve is opened and closed. Therefore, in spite of being normal, the fuel vapor diffusion preventing unit is judged to be abnormal and false detection results. Further, when density of the fuel vapor is rich, the air/fuel ratio is changed even in the event there occur cracks or the like in part of pipes. Consequently, in spite of being abnormal, the fuel vapor diffusion preventing unit is judged to be normal and false detection results.

In addition, duty - flow rate characteristics of the purge control valve are varied to a large extent, particularly in the range of low flow rates, due to tolerance in manufacture, changes over time and other causes. This gives rise to the problem that the purge control valve cannot be controlled to a target flow rate, the air/fuel ratio is fluctuated, and further exhaust emissions are deteriorated. In particular, at the beginning of the operation restarted after keeping automobiles stopped for a long period of time, the amount of fuel adsorbed in the canister is large so that the amount of fuel vapor purged is large. Therefore, exhaust emissions is further deteriorated due to variations in characteristics of the purge control valve.

SUMMARY OF THE INVENTION

An object of the present invention is to effectively utilize idling rotational speed control means which adjusts an amount of intake air into an internal combustion engine so that a target rotational speed is achieved during idling of the internal combustion engine, thereby detecting the condition of a purge control valve.

Another object of the present invention is to detect a failure in flow rate characteristics of pipings connecting a canister and an intake pipe, as well as a fuel gas supply passage having therein a purge control valve, without being affected by density of fuel vapor purged from the canister to the intake pipe, thereby detecting a reduction in the purging ability of a purge system.

Still another object of the present invention is to learn the position at which the purge control valve opens, and correct variations in the valve-opening position thereby to prevent deterioration of exhaust emissions.

The present invention resides in an internal combustion engine ,controller comprising, as shown in FIG. 17, a canister M1 loaded with an adsorbent to adsorb fuel vapor produced in a fuel tank containing liquid fuel, a supply passage M2 for introducing the fuel vapor adsorbed by the adsorbent in said canister M1 to an intake pipe of an internal combustion engine under an action of the negative pressure produced in said intake pipe, a purge control valve M3 provided midway said supply passage M2 and capable of adjusting its opening degree, purge flow rate control means M4 for adjusting the opening degree of said purge control valve M3 depending on operating condition of said internal combustion engine to control a flow rate of the fuel vapor purged through said supply passage M2, a rotational speed control valve M5 for adjusting an amount of intake air into said internal combustion engine with adjustment of its opening degree to change a rotational speed of said internal combustion engine, idling rotational speed control means M6 for adjusting the opening degree of said rotational speed control valve M5 to control the amount of the intake air so that a target rotational speed is achieved during idling of said internal combustion engine, air/fuel ratio detecting means M7 for detecting an air/fuel ratio of a gas mixture supplied to said internal combustion engine, air/fuel ratio control means M8 for controlling the air/fuel ratio, detected by said air/fuel ratio detecting means M7, of the gas mixture supplied to said internal combustion engine to be held constant, and opening change calculating means M9 for forcibly changing the opening degree of said purge control valve M3 by said purge flow rate control means M4 and determining a change in the opening degree of said rotational speed control valve M5 at that time under air/fuel ratio control by said air/fuel ratio control means M8 and rotational speed control by said idling rotational speed control means M6.

Also, said opening change calculating means M9 may be designed to forcibly change the opening degree of said purge control valve M3 to a first set opening degree and a second set opening degree by said purge flow rate control means M4 and determine a change in the opening degree of said rotational speed control valve M5 resulting when the opening degree of said purge control valve M3 is changed from the first set opening degree to the second set opening degree, and said controller may further comprise abnormality determining means M10 for determining that an abnormality in supply of the fuel vapor to said intake pipe has occurred due to an abnormality in at least one of said supply passage M2 and said purge control valve M3, if the change in the opening degree of said rotational speed control valve M5 derived by said opening change calculating means M9 is out of a preset allowable range, and alarm means M11 for issuing an alarm when the presence of an abnormality is determined by said abnormality determining means M10.

Furthermore, said opening change calculating means M9 may be designed to determine a change in the opening degree of said rotational speed control valve M5 resulting when said purge control valve M3 is gradually opened from a fully closed state by said purge flow rate control means M4, and said controller may further comprise purge control valve opening position detecting means M12 for storing the opening degree of said purge control valve M3 resulting when the change in the opening degree of said rotational speed control valve M5 derived by said opening change calculating means M9 exceeds a predetermined value set in advance, as a position at which said purge control valve M3 actually begins to open, and purge control valve flow rate characteristic learning means M13 for learning a flow rate characteristic of said purge control valve M3 depending on the opening position stored in said purge control valve opening position detecting means M12.

In a condition where the air/fuel ratio is held constant by the air/fuel ratio control means M8 and the rotational speed is held constant by the idling rotational speed control means M6 while the engine is idling, the opening change calculating means M9 forcibly changes the opening degree of the purge control valve M3 through the purge flow rate control means M4 and determines the change in the opening degree of the rotational speed control valve M5 at that time.

On this occasion, the opening change calculating means M9 may forcibly change the opening degree of the purge control valve M3 to the first set opening degree and the second set opening degree by the purge flow rate control means M4 and determine the change in the opening degree of the rotational speed control valve M5 resulting when the opening degree of the purge control valve M3 is changed from the first set opening degree to the second set opening degree. If the change in the opening degree of the rotational speed control valve M5 derived by the opening change calculating means M9 is out of the preset allowable range, the abnormality determining means M10 determines that an abnormality in supply of the fuel vapor to the intake pipe has occurred due to an abnormality in at least one of the supply passage M2 and the purge control valve M3. When the presence of an abnormality is determined by the abnormality determining means M10, the alarm means M11 issues an alarm.

Stated otherwise, while the purged flow rate is varied depending on changes in opening degree of the purge control valve M3 and thus the air/fuel ratio is varied, the air/fuel ratio is maintained constant at all times by the air/fuel ratio control means M8 and, therefore, the opening degree of the rotational speed control valve M5 is varied under such control depending on changes in the purged flow rate through the purge control valve M3. Accordingly, changes in the opening degree of the rotational speed control valve M5 caused depending on changes in the opening degree of the purge control valve M3 represent changes in the purged flow rate through the purge control valve M3, enabling an abnormality to be detected based on the changes in the purged flow rate.

As an alternative, the opening change calculating means M9 may determine the change in the opening degree of the rotational speed control valve M5 resulting when the purge control valve M3 is gradually opened from a fully closed state by the purge flow rate control means M4. The purge control valve opening position detecting means M12 stores the opening degree of the purge control valve M3 resulting when the change in the opening degree of the rotational speed control valve M5 derived by the opening change calculating means M9 exceeds the predetermined value set in advance, as the position at which the purge control valve M3 actually begins to open. Moreover, the purge control valve flow rate characteristic learning means M13 learns the flow rate characteristic of the purge control valve M3 depending on the opening position stored in the purge control valve opening position detecting means M12.

DETAILED DESCRIPTION OF THE PREFERRED EMBODIMENT

Hereinafter, one embodiment of the present invention will be described with reference to the drawings.

Figure 1:
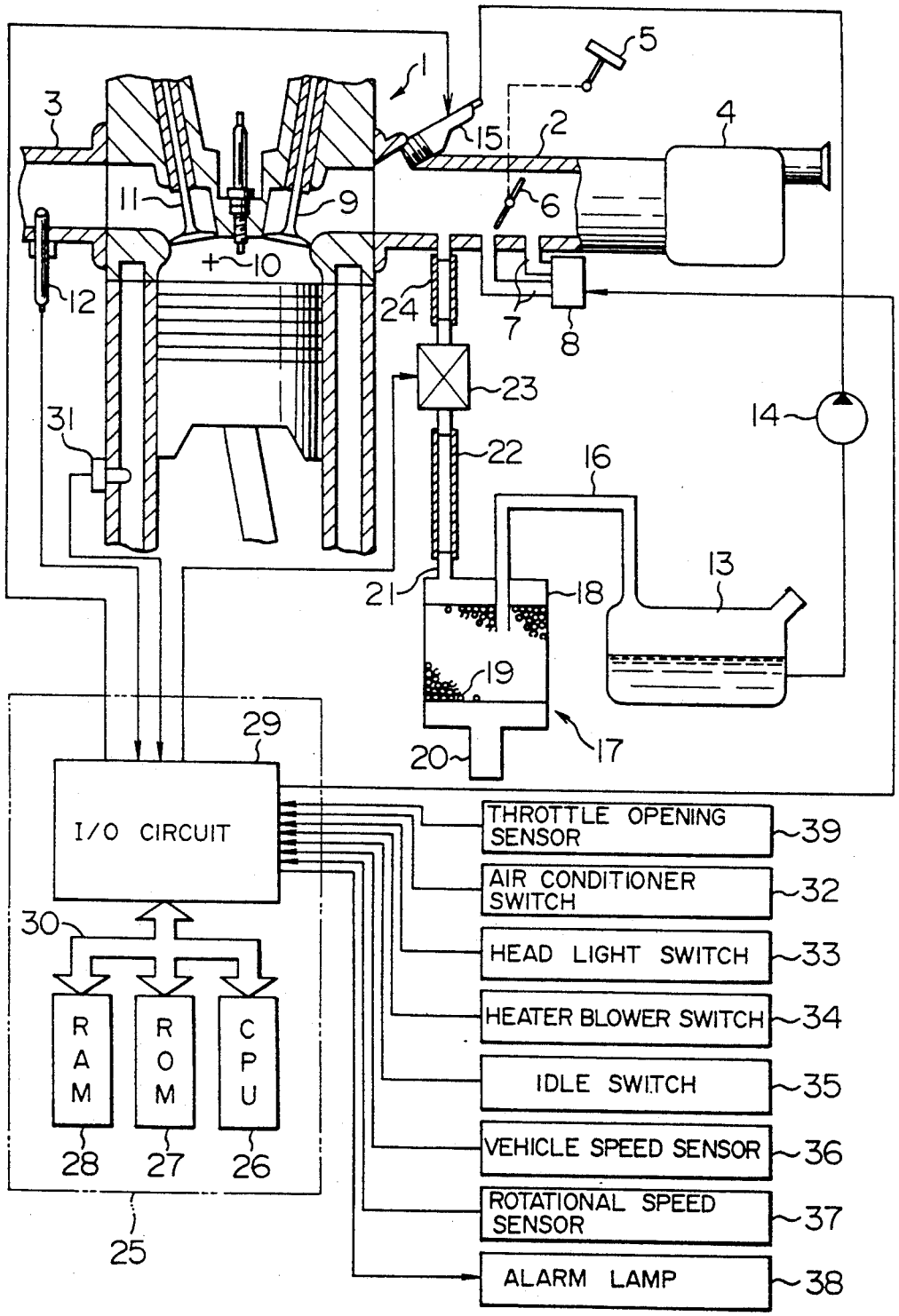
FIG. 1 is a view showing an outline of the configuration in the vicinity of an engine according to an embodiment of the present invention.

FIG. 1 shows an outline of the configuration in the vicinity of an engine mounted on an automobile. Connected to an engine 1 are an intake pipe 2 and an exhaust pipe 3. An air cleaner 4 for filtering air is disposed upstream of the intake pipe 2 so that air is sucked into the intake pipe 2 through the air cleaner 4. In the intake pipe 2, there is provided a throttle valve 6 which is operated to open and close in interlock with an accelerator pedal 5. Further, a bypass passage 7 is provided to bypass the throttle valve 6 and a rotational speed control valve 8 is disposed midway the bypass passage 7. By regulating an opening degree of the rotational speed control valve 8 under duty control, the amount of intake air is adjusted while the engine 1 is idling, for changing a rotational speed of the engine.

The air from the intake pipe 2 is supplied to a combustion chamber 10 through an intake valve 9. Exhaust gas in the combustion chamber 10 is discharged to the exhaust pipe 3 through an exhaust valve 11. An $O_2$ sensor 12 serving as air/fuel ratio detecting means is provided in the exhaust pipe 3.

On the other hand, a fuel pump 14 is connected to a fuel tank 13 containing liquid fuel such that the fuel pump 14 feeds the fuel in the fuel tank 13 under pressure. The fuel fed by the fuel pump 14 is supplied to a fuel injection valve 15 provided in the intake pipe 2, and is injected upon opening and closing of the fuel injection valve 15. The fuel tank 13 is also connected to a canister 17 by a connecting pipe 16, and a canister body 18 contains an adsorbent 19, e.g., activated charcoal, which adsorbs fuel vapor. The fuel vapor produced in the fuel tank 13 is thereby adsorbed by the adsorbent 19 in the canister 17 through the connecting pipe 16. Additionally, the canister body 18 is formed with a hole 20 open to the atmosphere, allowing air to be sucked into the interior of the canister body.

The canister body 18 is also formed with a hose connecting portion 21 into which one end of a supply pipe 22 is inserted. The other end of the supply pipe 22 is connected to a purge control valve 23. Connected to the purge control valve 23 is one end of another supply pipe 24 the other end of which is connected to the intake pipe 2. Thus, the purge control valve 23 is interposed between both the supply pipes 22 and 24 so that the intake pipe 2 and the canister 17 are communicated with each other through the supply pipe 22, the purge control valve 23 and the supply pipe 24. Such a communicating condition permits the fuel vapor adsorbed by the adsorbent 19 in the canister 17 to be introduced to the intake pipe 2 under an action of the negative pressure produced in the intake pipe 2 of the engine 1. An opening degree of the purge control valve 23 can be adjusted under duty control to correspondingly change a flow rate of the fuel vapor purged through both the supply pipes 22 and 24. Additionally, the supply pipes 22, 24 are generally formed of flexible tubes such as rubber hoses or nylon hoses.

An electronic control circuit 25 serving as purged flow rate control means, idling rotational speed control means, air/fuel ratio control means, opening change calculating means and abnormality determining means comprises a CPU 26, a ROM 27, a RAM 28 and an input/output circuit 29. These components are connected to one another via a common bus 30. The ROM 27 stores control programs and data for the CPU 26 in advance. The RAM 28 is capable of freely reading and writing data. The CPU 26 receives various signals through the input/output circuit 29. More specifically, the CPU 26 receives a signal from the Oz sensor 12, a signal from a water temperature sensor 31 for detecting a temperature of engine cooling water, a signal from a throttle opening sensor 39 for detecting an opening degree of the throttle valve 6, a signal from an air conditioner switch 32 for detecting on/off operation of a car-mounted air conditioner, a signal from a head light switch 33 for detecting turn-on operation of head lights, a signal from a heater blower switch 34, a signal from an idle switch 35 turned on when the accelerator pedal 5 is not trod down, a signal from a vehicle speed sensor 36, and a signal from a rotational speed sensor 37 for detecting a rotational speed of the engine.

Based on the above signals, the programs and data stored in the ROM 27 and the RAM 28, etc., the CPU 26 drives and controls the fuel injection valve 15, the purge control valve 23 and the rotational speed control valve 8 through the input/output circuit 29.

To described in more detail, depending on operating condition of the engine 1, the CPU 26 regulates the opening degree of the purge control valve 23 to thereby control the purged flow rate through the supply pipes 22, 24. In other words, the opening degree of the purge control valve 23 is calculated and controlled by the CPU 26 so that the purged flow rate is held at a predetermined proportion with respect to the amount of intake air detected by an intake sensor (not shown). The CPU 26 also regulates the opening degree of the rotational speed valve 8 to control the amount of intake air so that a target rotational speed is achieved during idling of the engine 1, and further controls the air/fuel ratio of a gas mixture supplied to the engine 1 to be held constant, the ratio being detected by the $O_2$ sensor 12. Stated otherwise, the CPU 26 determines a basic injection time based on both the engine rotational speed from the rotational speed sensor 37 and the amount of intake air detected by the intake sensor (not shown), corrects the basic injection time using a feedback amendment factor FAF or the like to determine a final injection time, and then instructs the fuel injection valve 15 to inject fuel at predetermined injection timing.

Incidentally, an alarm lamp 38 serving as alarm means is provided on an instrument panel of the automobile and connected to the CPU 26 through the input/output circuit 29.

Operation of a self-diagnosis device in the fuel vapor diffusion preventing unit thus constructed will be next described below.

Figure 2:
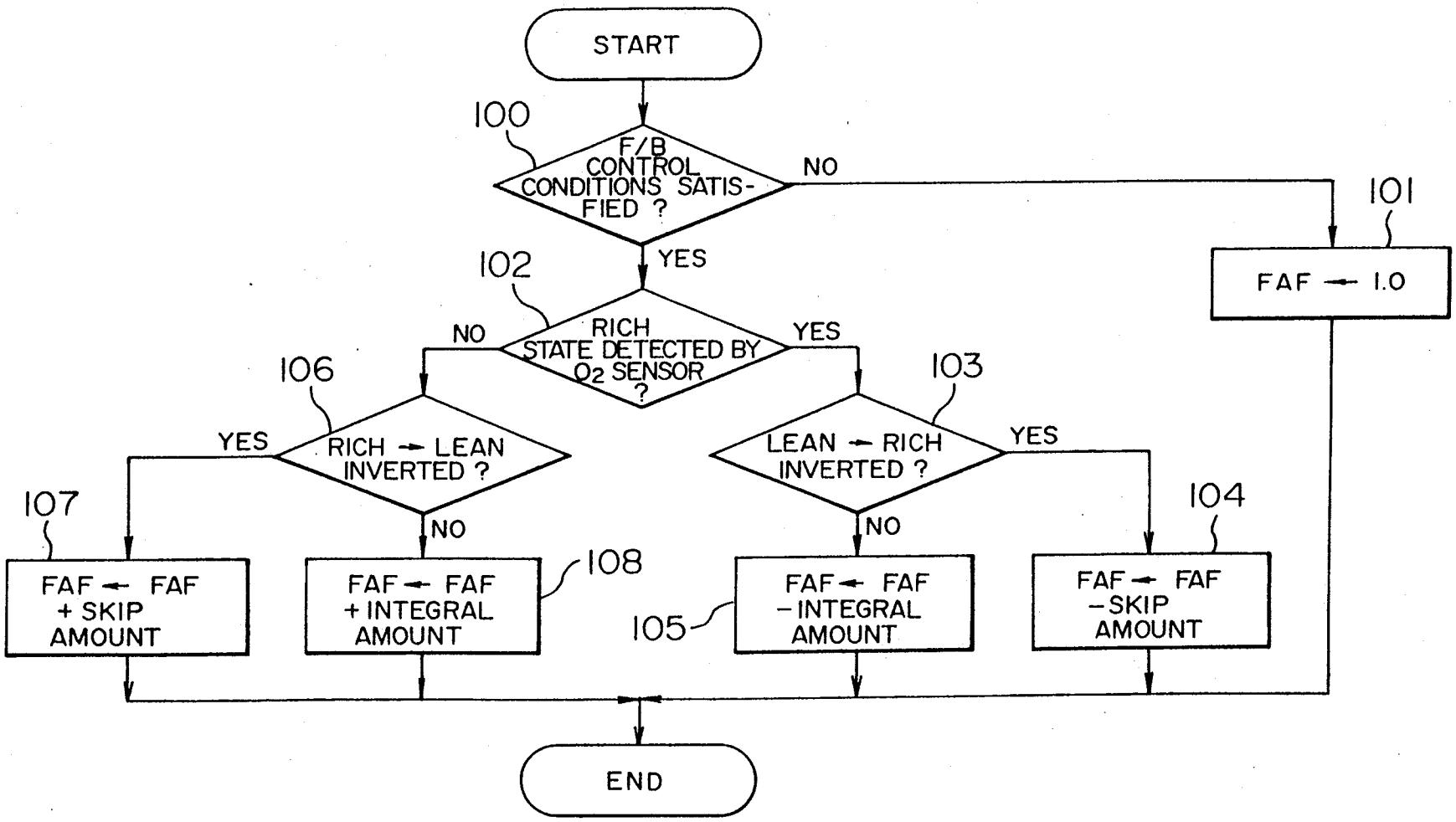
FIG. 2 is a flowchart for explaining operation of the embodiment of the present invention.

First, feedback control of the air/fuel ratio will be explained with reference to FIG. 2. This control process is executed once for a predetermined period of time.

Figure 3:
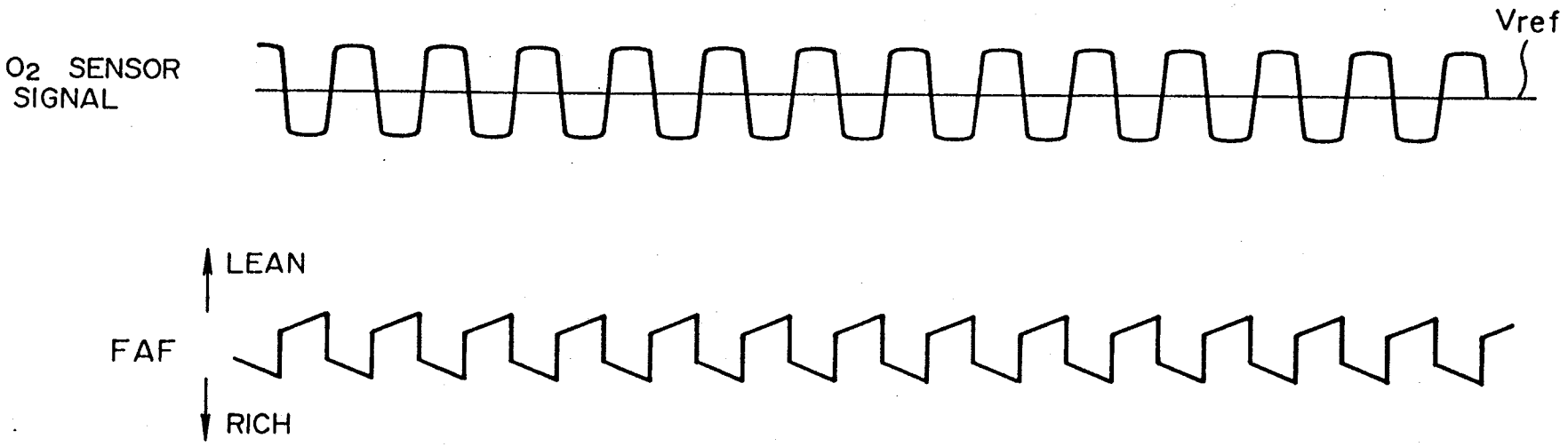
FIG. 3 is a timing chart for explaining an air/fuel ratio control process.

As shown in FIG. 3, the CPU 26 compares the output voltage of the Oz sensor 12 with the reference voltage Vref to determine whether the gas mixture is rich or lean. Then, the CPU 26 determines in a step 100 whether conditions for feedback (F/B) control are satisfied or not. The conditions are determined to be satisfied when the temperature of the engine cooling water detected by the water temperature sensor 31 is not lower than 40° C. and the throttle opening degree detected by the throttle opening sensor 39 is not larger than 70°. If the feedback control conditions are not satisfied, then the CPU 26 goes to a step 101 where the feedback amendment factor FAF is set to FAF=1.0.

If the feedback control conditions are satisfied, then the CPU 26 determines in a step 102 based on the signal from the $O_2$ sensor 12 whether the air/fuel ratio is rich or not. If rich, then the CPU 26 compares in a step 103 the current air/fuel ratio with the result detected in the previous cycle to determine whether the air/fuel ratio has been inverted from a lean state to a rich state or not. If the lean state has been inverted to the rich state, then the CPU 26 sets in a step 104 a feedback amendment factor FAF-$\alpha$ (where $\alpha$ is a skip amount) as a new value of the feedback amendment factor FAF. If the lean state has not been inverted to the rich state, then the CPU 26 sets in a step 105 a feedback amendment factor FAF-$\beta$ (where $\beta$ is an integral amount, $\alpha > \beta$) as a new value of the feedback amendment factor FAF.

Meanwhile, if the air/fuel ratio is determined to be lean in the above step 102, then the CPU 26 compares in a step 106 the current air/fuel ratio with the result detected in the previous cycle to determine whether the air/fuel ratio has been inverted from the rich state to the lean state or not. If the rich state has been inverted to the lean state, then the CPU 26 sets in a step 107 a feedback amendment factor FAF+$\alpha$ (where $\alpha$ is a skip amount) as a new value of the feedback amendment factor FAF. If the rich state has not been inverted to the lean state, then the CPU 26 sets in a step 108 a feedback amendment factor FAF+$\beta$ (where $\beta$ is an integral amount) as a new value of the feedback amendment factor FAF.

Accordingly, through the process of the above steps 102 to 108, if the rich state has been inverted to the lean state, or vice versa, then the feedback amendment factor FAF is stepwisely changed (skipped) to increase or decrease the amount of fuel injected. If the rich or lean state remains unchanged, then the feedback amendment factor FAF is gradually increased or decreased.

Figure 4:
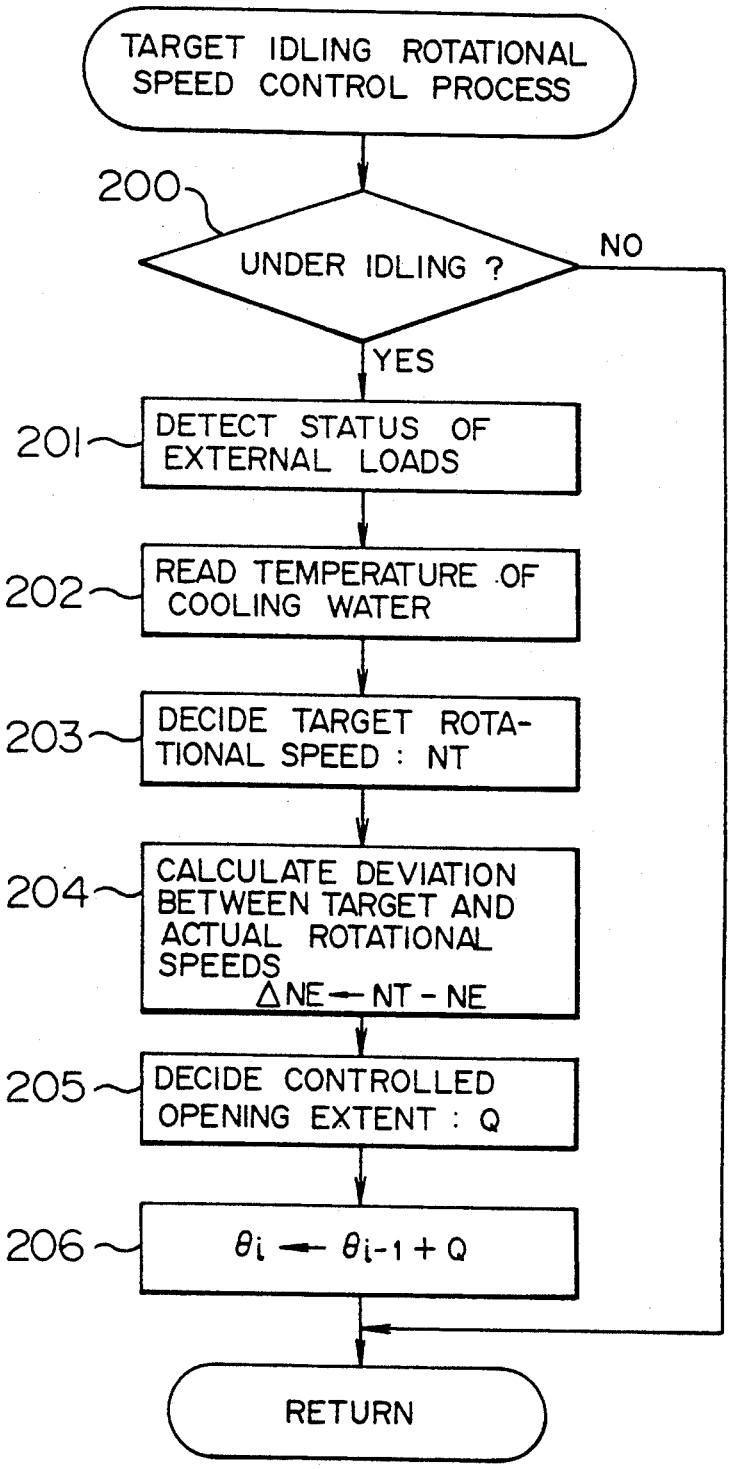
FIG. 4 is a flowchart for explaining operation.

FIG. 4 shows a target idling rotational speed control routine executed once for a predetermined period of time.

Figure 5:
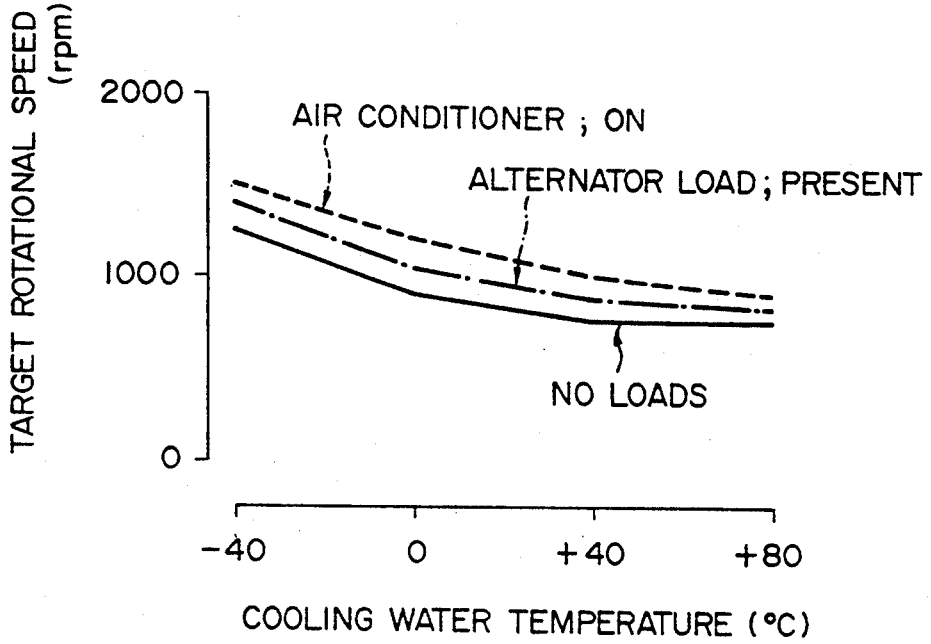
FIG. 5 is a map for determining a target rotational speed with respect to a temperature of cooling water.

The CPU 26 determines in a step 200 whether the engine is idling or not. The engine is determined to be under idling when the idle switch 35 is turned on and the vehicle speed detected by the vehicle speed sensor 36 is not higher than 2 Km/h. If under idling, then the CPU 26 goes to a step 201 to detect operative status of the air conditioner switch 32 and status of alternator loads (i.e., operative status of the head light switch 33 and the heater blower switch 34), followed by going to a step 202 to read the temperature of the engine cooling water detected by the water temperature sensor 31. The CPU 26 decides a target rotational speed NT in a step 203. The target rotational speed NT is decided using a map shown in FIG. 5 depending on the load status (no loads, presence of the alternator load, and turn-on of the air conditioner) related to the temperature of the engine cooling water.

Figure 6:
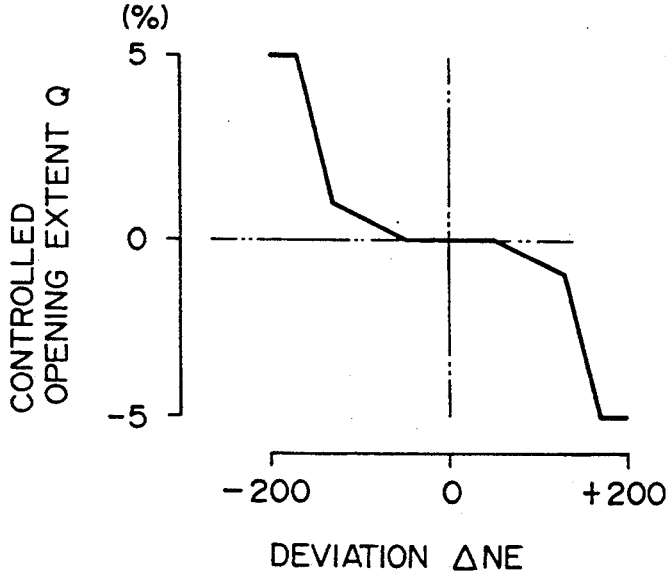
FIG. 6 is a map for determining a controlled opening extent with respect to a deviation of the rotational speed.
Figure 7:
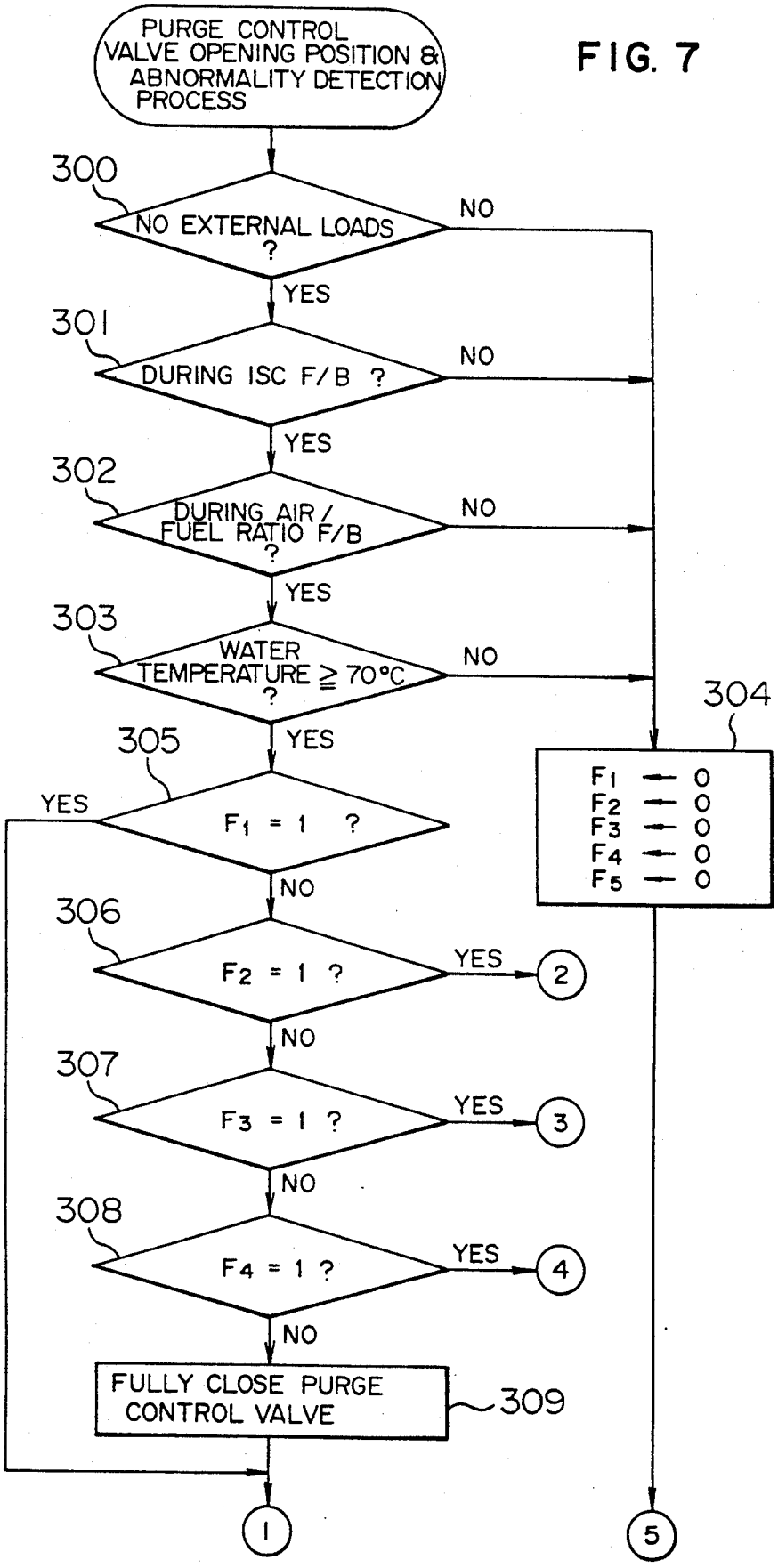
FIG. 7 is a flowchart for explaining operation.
Figure 8:
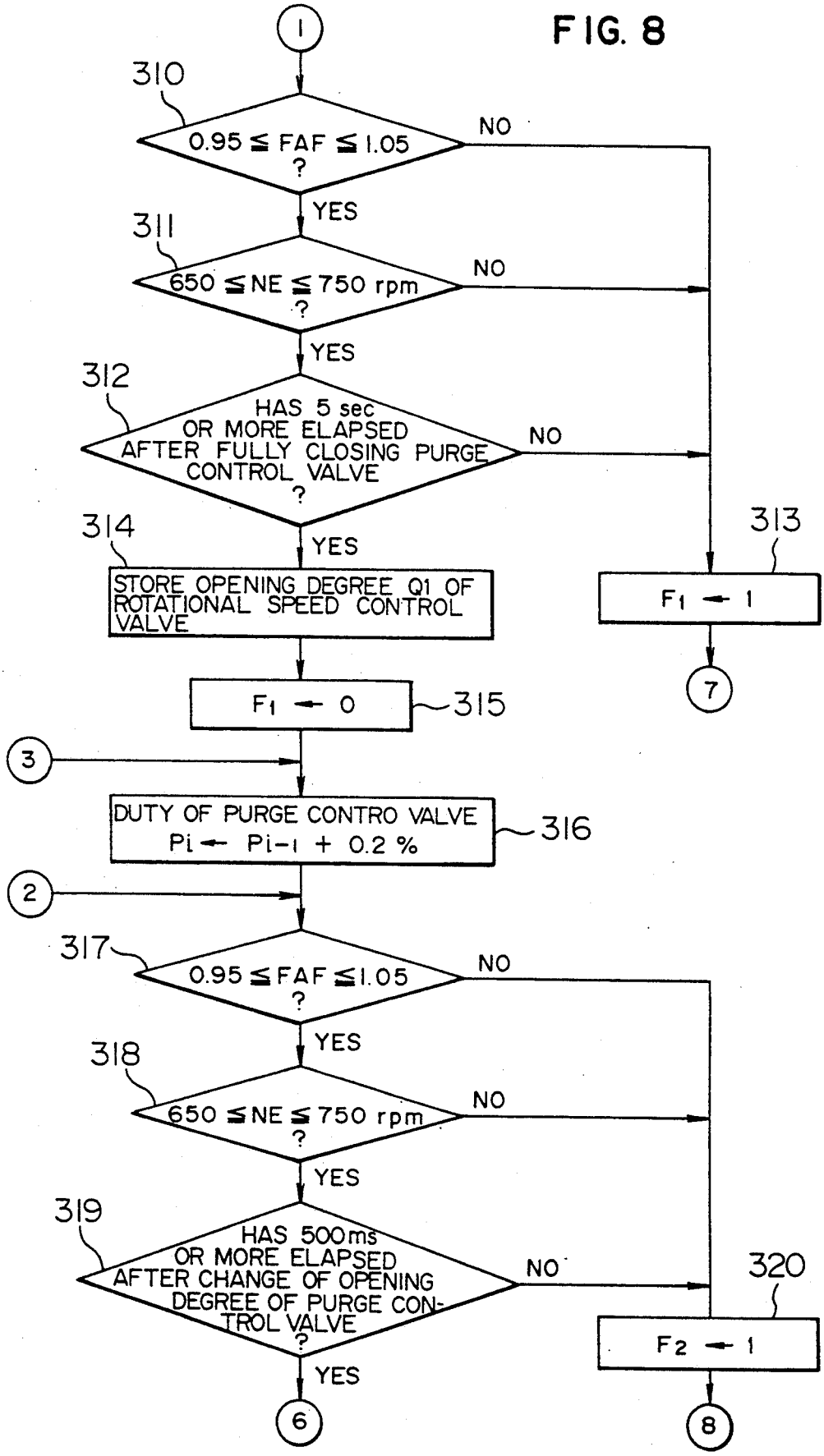
FIG. 8 is a flowchart for explaining operation.
Figure 9:
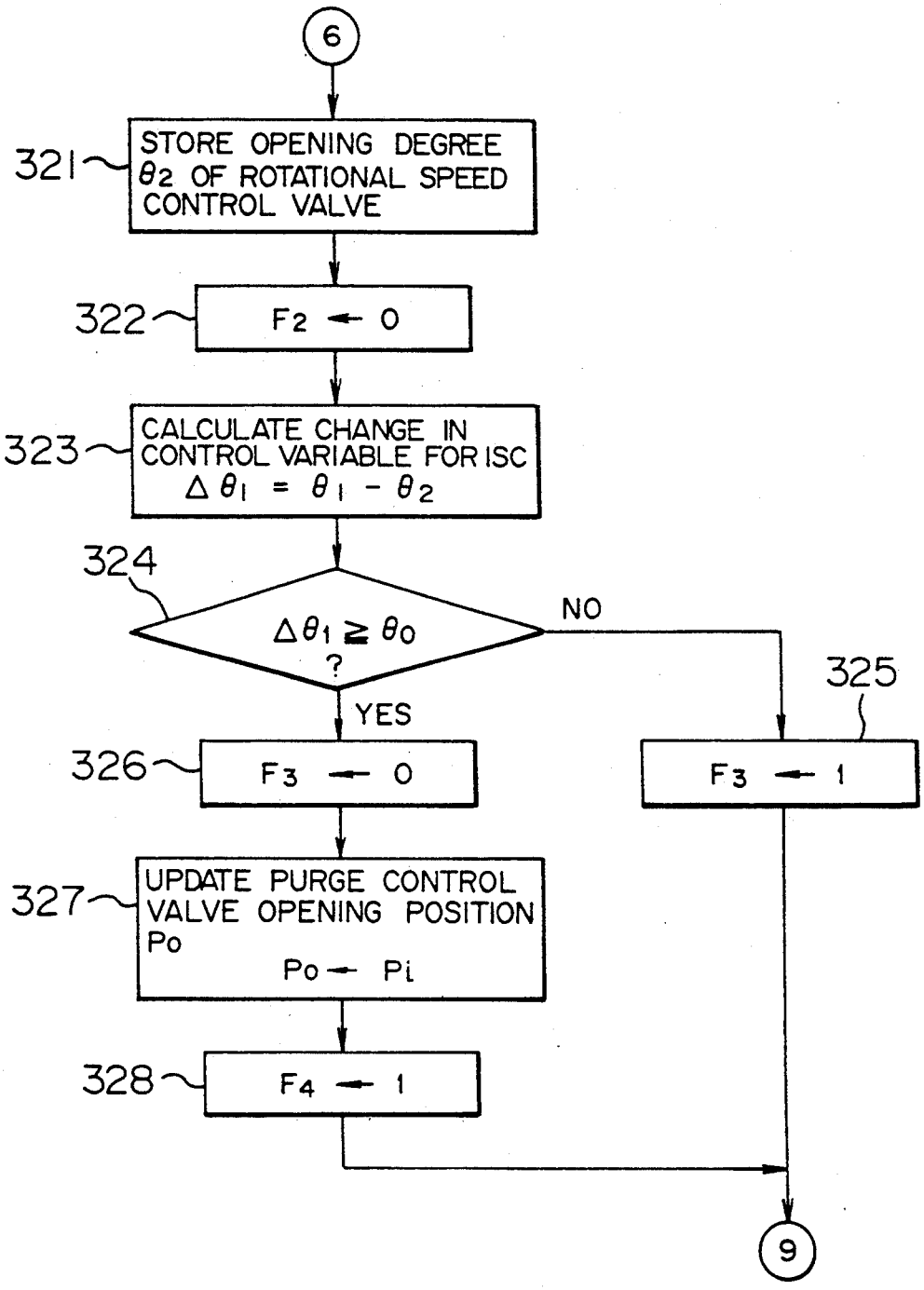
FIG. 9 is a flowchart for explaining operation.

Next, the CPU 26 calculates in a step 204 a deviation $\Delta NE$ (=NT−NE) between the target rotational speed NT and an actual engine rotational speed NE detected by the rotational speed sensor 37, and further calculates in a step 205 a controlled opening extent Q of the rotational speed control valve 8. The calculation of the controlled opening extent Q is carried out by determining the controlled opening extent Q corresponding to the deviation $\Delta NE$ in the rotational speed using a map shown in FIG. 6. In a next step 206, the CPU 26 sets the value resulting from adding the controlled opening extent Q to the previous opening degree $\theta_{i-1}$ of the rotational speed control valve 8 as a current opening degree $\theta_i$ of the rotational speed control valve 8, and operates the rotational speed control valve 8 under duty control so that it provides the opening degree $\theta_i$.

FIGS. 7 to 11 show a purge control valve opening position and abnormality detection process routine executed once for a predetermined period of time. This process will be explained below with reference to a timing chart of FIG. 12.

Figure 12:
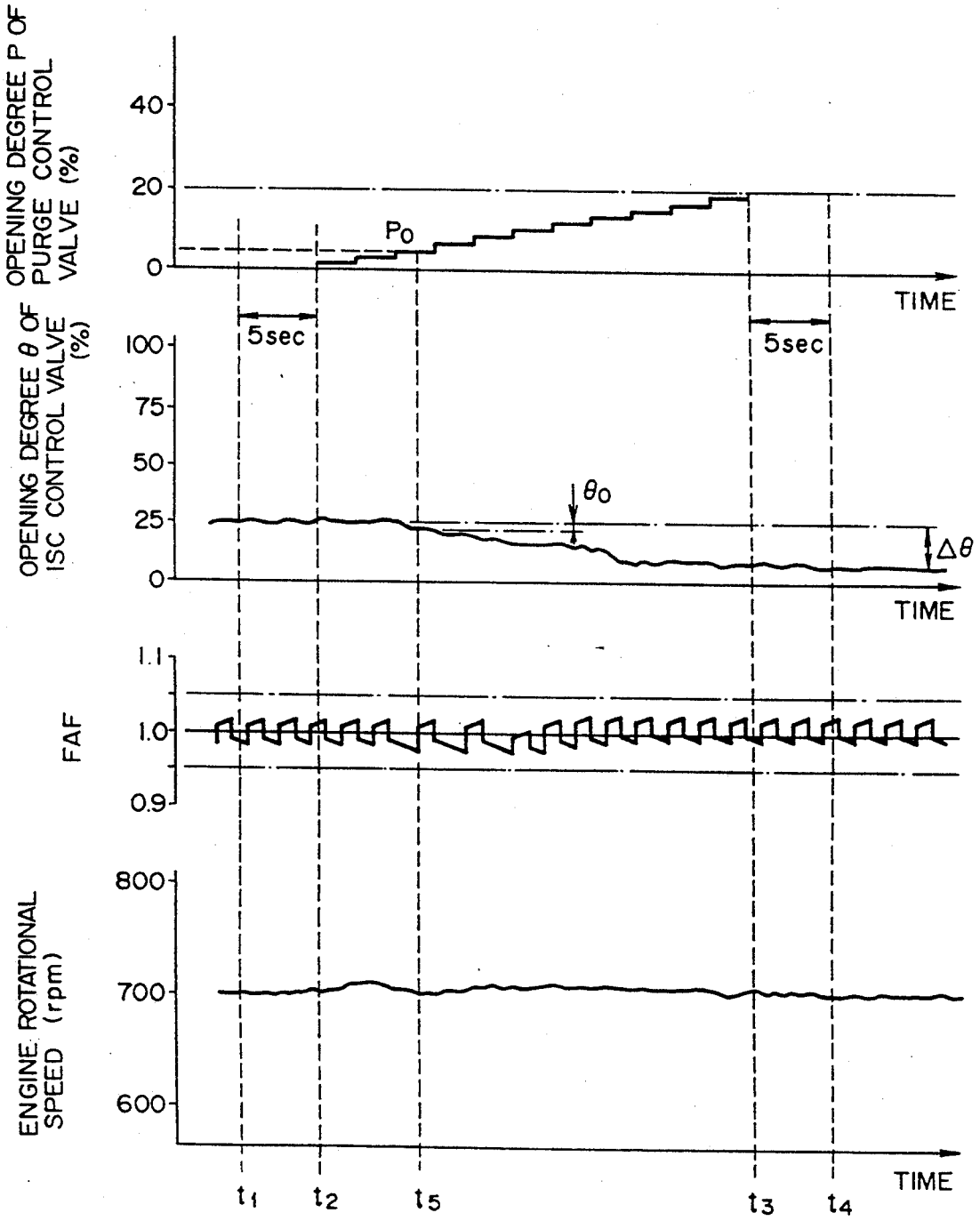
FIG. 12 is a timing chart showing various processes.

First, at timing of t1 in FIG. 12, the CPU 26 determines in steps 300, 301, 302 and 303 whether or not the system is in a condition capable of executing abnormality detection. More specifically, the CPU 26 confirms in the step 300 that any external loads (i.e., the load of the air conditioner as well as the alternator loads due to operation of the head lights and the blower motor), which may cause changes in the amount of intake air during the idling, are not present, confirms in the step 301 that the target idling rotational speed control is being executed, confirms in the step 302 that the feedback control for controlling the air/fuel ratio to be held constant with the aid of the $O_2$ sensor 12 is being executed, and further determines in the step 303 whether the temperature of the engine cooling water is not lower than 70° C.

If any of the conditions of the steps 300, 301, 302 and 303 is not satisfied, then the CPU 26 sets all flags F1, F2, F3, F4 and F5 to "0" in a step 304.

If the conditions for executing the abnormality detection process are all satisfied, then the CPU 26 determines in steps 305, 306, 307 and 308 whether the flags F1, F2, F3 and F4 are set to "1" or not, respectively. In the first cycle, F1, F2, F3, F4=0 holds because of the initialization or the process in the step 304 and, therefore, a duty of the purge control valve 23 is set to zero in a step 309 for making the purge control valve 23 fully closed. In a next step 310 of FIG. 8, the CPU 26 checks whether the feedback amendment factor FAF under the air/fuel ratio feedback control with the aid of the $O_2$ sensor 12 falls within the range of 0.95 to 1.05 or not, i.e., whether the air/fuel ratio is in the vicinity of the target air/fuel ratio or not. If the feedback amendment factor FAF falls within the range of 0.95 to 1.05, then the CPU 26 checks in a step 311 whether the engine rotational speed under the idling rotational speed feedback control is in the vicinity (650 to 750 rpm) of the target rotational speed or not.

If the engine rotational speed is in the vicinity of the target rotational speed, then the CPU 26 determines in a step 312 whether 5 seconds has elapsed or not after fully closing the purge control valve 23, i.e., whether the stable condition continues for at least a predetermined period of time (5 seconds) or not. If 5 seconds has not yet elapsed, then the CPU 26 sets the flag F1 to "1" in a step 313.

In a next cycle of the process, when the CPU 26 goes through the steps 300→301→302→303→305, F1=1 now holds in the step 305 and thus the CPU 26 subsequently goes through the steps 310→311→312→313, followed by repeating such a process. If it is determined in the step 312 that 5 seconds has elapsed after fully closing the purge control valve 23 (at timing of t2 in FIG. 12), the duty value of the rotational speed control valve 8 at that time is stored as an opening degree $\theta 1$ thereof in a step 314. In other words, the opening degree $\theta 1$ of the rotational speed control valve 8 is read as an amount of intake air through the bypass passage 7 resulting when the purge control valve 23 is fully closed (opening degree: 0%) at the duty of 0%.

Thereafter, the CPU 26 sets the flag F1 to "0" in a step 315 and further sets the value resulting from adding 0.2% to the previous duty $P_{i-1}$ of the purge control valve 23, in a step 316, as a current duty $P_i$ of the purge control valve 23, thereby increasing the duty of the purge control valve 23 by 0.2%. Subsequently, the CPU 26 checks in a step 317 whether the feedback amendment factor FAF under the air/fuel ratio feedback control with the aid of the $O_2$ sensor 12 falls within the range of 0.95 to 1.05 or not, i.e., whether the air/fuel ratio is in the vicinity of the target air/fuel ratio or not. If the feedback amendment factor FAF falls within the range of 0.95 to 1.05, then the CPU 26 checks in a step 318 whether the engine rotational speed under the idling rotational speed feedback control is in the vicinity (650 to 750 rpm) to the target rotational speed or not.

If the engine rotational speed is in the vicinity of the target rotational speed, then the CPU 26 determines in a step 319 whether 500 ms or more has elapsed or not after changing the duty of the purge control valve 23 in the step 316, i.e., whether a period of time enough for the rotational speed control valve 8 to change its duty following change in the opening degree of the purge control valve 23 has elapsed or not. If 500 ms has not yet elapsed, then the CPU 26 sets the flag F2 to "1" in a step 320.

In a next cycle of the process, when the CPU 26 goes through the steps 300→301→302→303→305→306, F2=1 now holds in the step 306 and thus the CPU 26 subsequently goes through the steps 317→318→319→320, followed by repeating such a process. If it is determined in the step 319 that 500 ms has elapsed after changing the duty of the purge control valve 23, the duty value of the rotational speed control valve 8 at that time is stored as an opening degree $\theta 2$ in a step 321 of FIG. 9. In other words, the opening degree $\theta 2$ of the rotational speed control valve 8 is read as an amount of intake air through the bypass passage 7 when the duty of the purge control valve 23 is changed by 0.2%.

Thereafter, the CPU 26 sets the flag F2 to "0" in a step 322 and calculates in a step 323 a change $\Delta\theta 1$ $(=\theta 1-\theta 2)$ in the opening degree of the rotational speed control valve 8 (i.e., in the amount of intake air through the bypass passage) as resulting when the duty of the purge control valve 23 is changed by 0.2%. In a next step 324, the CPU 26 determines whether $\Delta\theta 1$ is not smaller than a predetermined value $\theta 0$ (e.g., 2%) or not. If the opening degree (duty) of the rotational speed control valve 8 is not changed in spite of that the duty of the purge control valve 23 has been changed from 0 by 0.2%, this means that the opening degree of the purge control valve 23 is 0 and, therefore, the flag F3 is set to "1" in a step 325.

In a next cycle of the process, when the CPU 26 goes through the steps 300→301→302→303→305→306→307, F3=1 now holds in the step 307 and thus the CPU 26 subsequently goes through the steps 316→317→318→319→321→322→323→324→325, thereby gradually increasing the duty of the purge control valve 23. When the purge control valve, 23 actually begins to open upon such a gradual increase in the duty of the purge control valve 23, the fuel vapor is introduced from the canister 17 to the intake pipe 2 of the engine 1. Consequently, since the amount of gas mixture introduced to the combustion chamber of the engine 1 is increased so as to raise the engine rotational speed, the feedback control for reducing the opening degree of the rotational speed control valve 8 is carried out by the target idling rotational speed control process routine of FIG. 4.

As a result, the duty change $\Delta\theta 1$ of the rotational speed control valve 8 becomes larger than the predetermined value $\theta 0$ in the step 324 (at timing t5 in FIG. 12). Therefore, the CPU 26 sets the flag F3 to "0" in a step 326, updates and stores the duty value $P_i$ of the purge control valve 23 at that time, in a step 327, as a position P0 where the purge control valve 23 actually opens, and further sets the flag F4 to "1" in a step 328.

Figure 10:
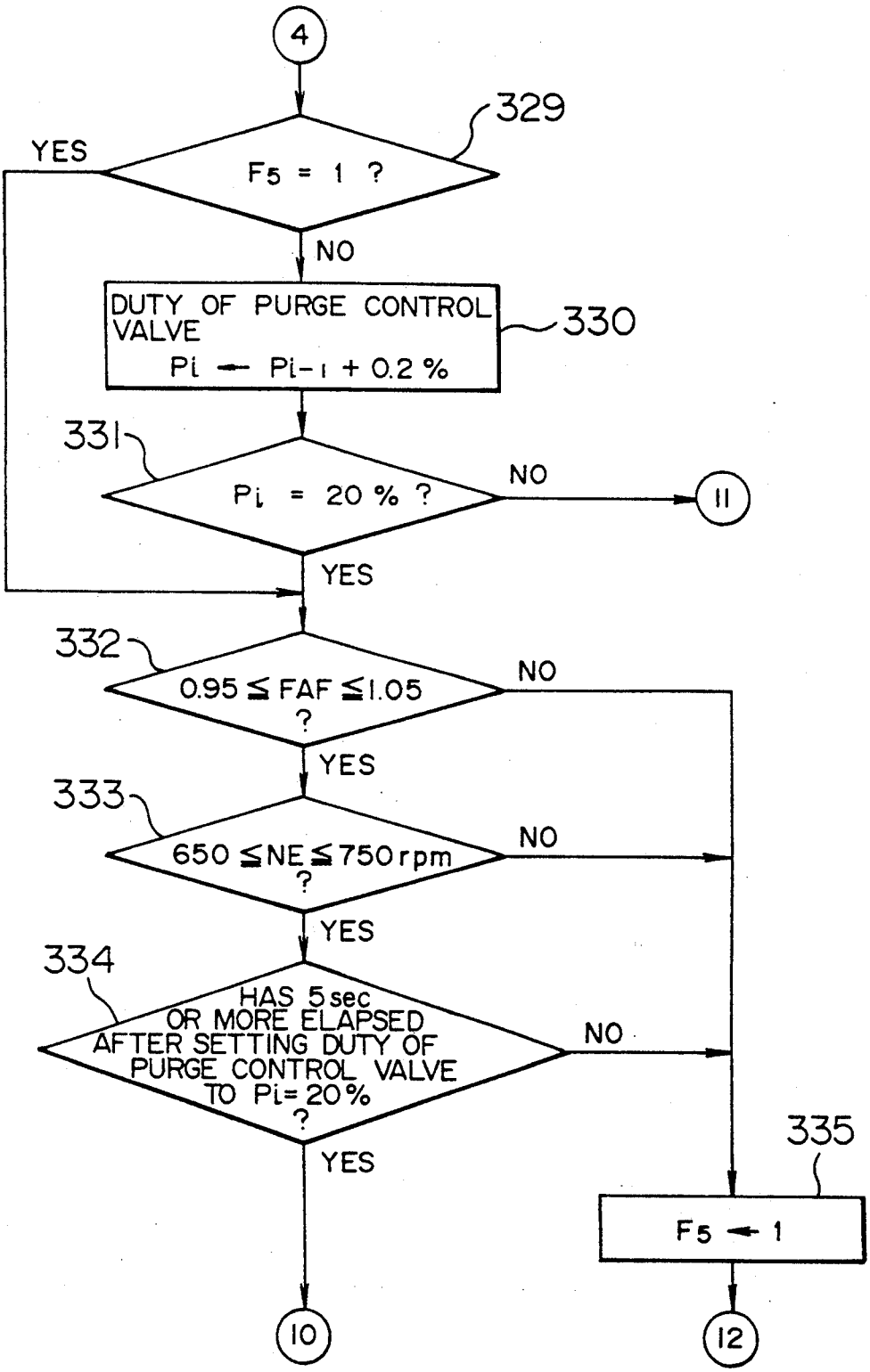
FIG. 10 is a flowchart for explaining operation.
Figure 11:
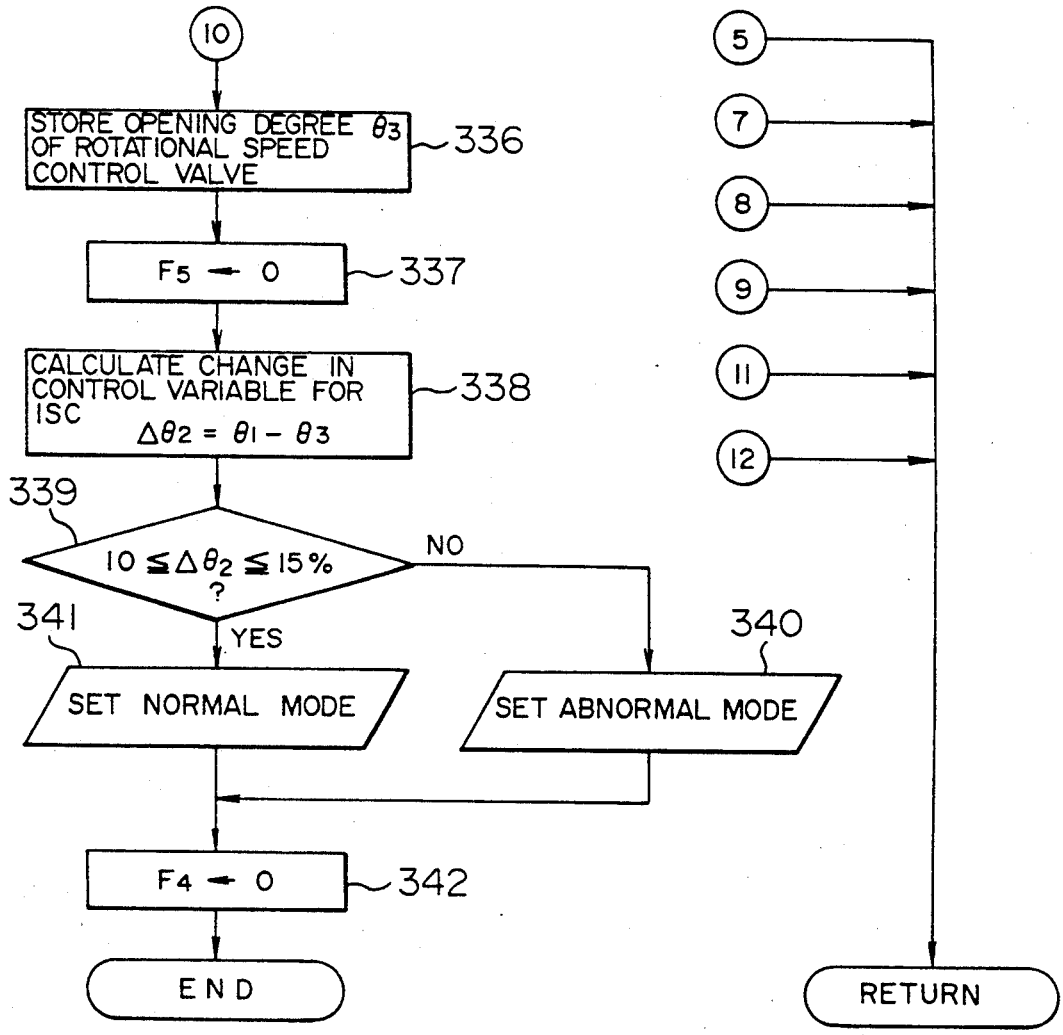
FIG. 11 is a flowchart for explaining operation.

In a next cycle of the process, when the CPU 26 goes through the steps 300→301→302→303→305→306→307→308, F4=1 now holds in the step 308 and thus the CPU 26 determines in a step 329 of FIG. 10 whether the flag F5 is "1" or not. At the beginning, F5=0 holds because of the initialization or the process in the step 304 and, therefore, the duty of the purge control valve 23 is increased by 0.2% in a step 330. After that, the CPU 26 determines in a step 331 whether the duty of the purge control valve 23 is equal to 20% or not. If the duty of the purge control valve 23 is not equal to 20%, then the CPU 26 returns to the first step 300 directly. When the duty of the purge control valve 23 is gradually increased by repeating the above process and reaches 20% in the step 331 (at timing of t3 in FIG. 12), the CPU 26 checks in a step 332 whether the feedback amendment factor FAF under the air/fuel ratio feedback control with the aid of the $O_2$ sensor 12 falls within the range of 0.95 to 1.05 or not, i.e., whether the air/fuel ratio is in the vicinity of the target air/fuel ratio or not. If the feedback amendment factor FAF falls within the range of 0.95 to 1.05, then the CPU 26 checks in a step 333 whether the engine rotational speed under the idling rotational speed feedback control is in the vicinity (650 to 750 rpm) of the target rotational speed or not.

If the engine rotational speed is in the vicinity of the target rotational speed, then the CPU 26 determines in a step 334 whether 5 seconds has elapsed or not after setting the duty of the purge control valve 23 to 20%, i.e., whether the stable condition continues for at least a predetermined period of time (5 seconds) or not. If 5 seconds has not yet elapsed, then the CPU 26 sets the flag F5 to "1" in a step 335.

In a next cycle of the process, when the CPU 26 goes through the steps 300→301→302→303→305→306→307→308, F4=1 now holds in the step 308 and thus the CPU 26 subsequently goes to the step 329 and, thereafter F5=1 now holds in the step 329 and thus the CPU 26 subsequently goes through the steps 332→333→334→335, followed by repeating such a process. If it is determined in the step 334 that 5 seconds has elapsed after setting the duty of the purge control valve 23 to 20% (at timing of t4 in FIG. 12), the duty value of the rotational speed control valve 8 at that time is stored as an opening degree $\theta 3$ thereof in a step 336 in FIG. 11. In other words, the opening degree $\theta 3$ of the rotational speed control valve 8 is read as an amount of intake air through the bypass passage 7 resulting when the purge control valve 23 is at the duty of 20%.

After that, the CPU 26 sets the flag F5 to "0" in a step 337 and calculates in a step 338 a change $\Delta\theta 2$ $(=\theta 1-\theta 3)$ in the opening degree of the rotational speed control valve 8 (i.e., in the amount of intake air through the bypass passage) as resulting when the duty of the purge control valve 23 is changed from 0% (fully closed state) to 20%. In a next step 339, the CPU 26 determines whether $\Delta\theta 2$ falls within a predetermined range (10 to 15%) or not. If the change in the opening degree of the rotational speed control valve 8 (i.e., in the amount of intake air through the bypass passage) is small in spite of that the duty of the purge control valve 23 has been changed from 0% (fully closed state) to 20%, this means that the suction resistance in pipings of the purge system and/or the purge control valve 23 is increased (due to clogging, folding of flexible tubes and other causes), resulting in detection of a failure in flow rate characteristics. On the contrary, if the change in the opening degree of the rotational speed control valve 8 (i.e., in the amount of intake air through the bypass passage) is large, this means that the suction resistance in pipings of the purge system and/or the purge control valve 23 is decreased (due to disconnection of pipes, cracks caused in pipes, the purge control valve 23 being kept fully open out of control, and other causes), similarly resulting in detection of a failure in flow rate characteristics.

If any failure in flow rate characteristics is detected in the step 339, then the CPU 26 sets an abnormal mode and lights up the alarm lamp 38 in a step 340. If no failure in flow rate characteristics is detected in the step 339, then the CPU 26 sets a normal mode in a step 341 and the process is ended by setting the flag F5 to "0" in a step 342.

Figure 13:
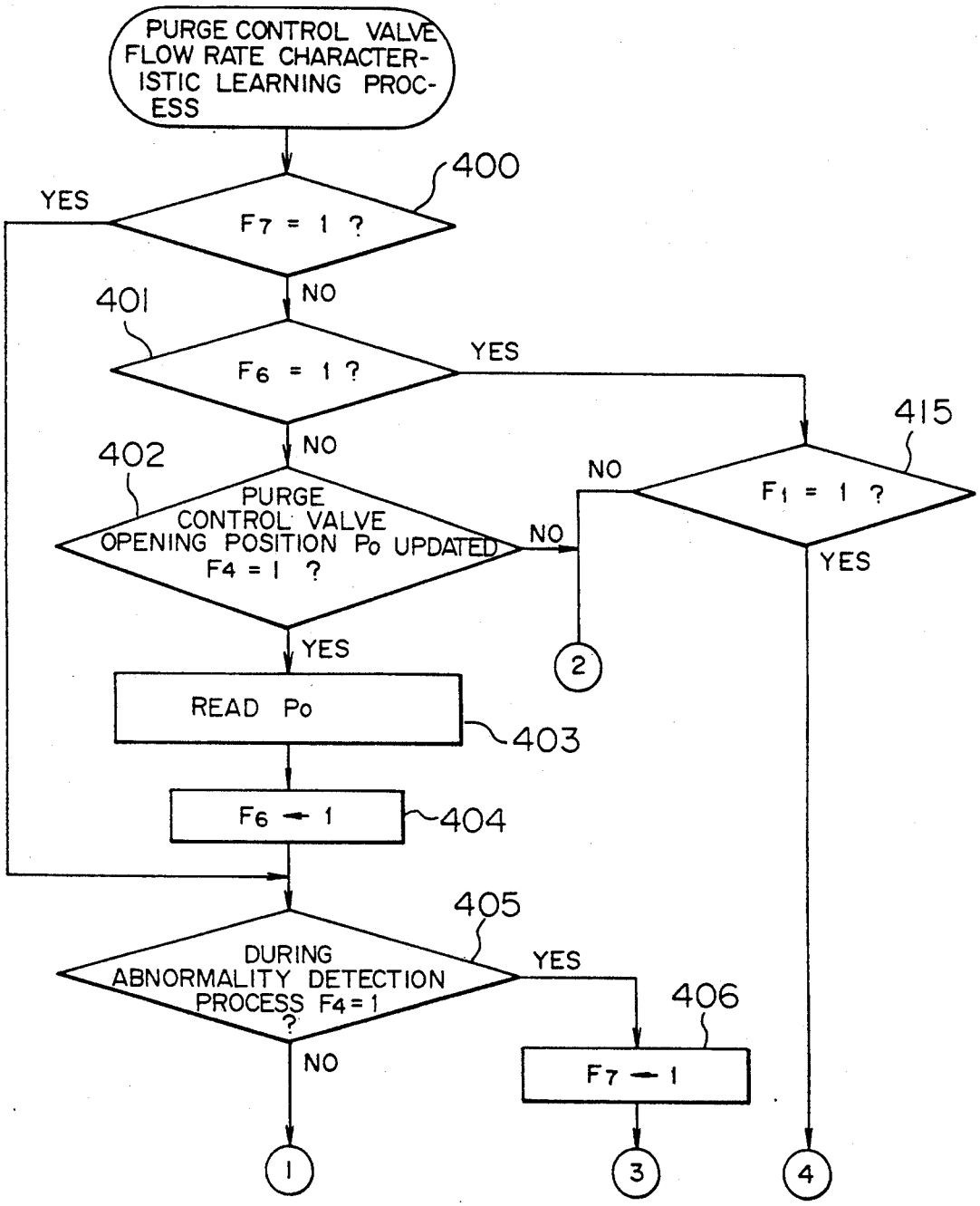
FIG. 13 is a flowchart for explaining operation.
Figure 14:
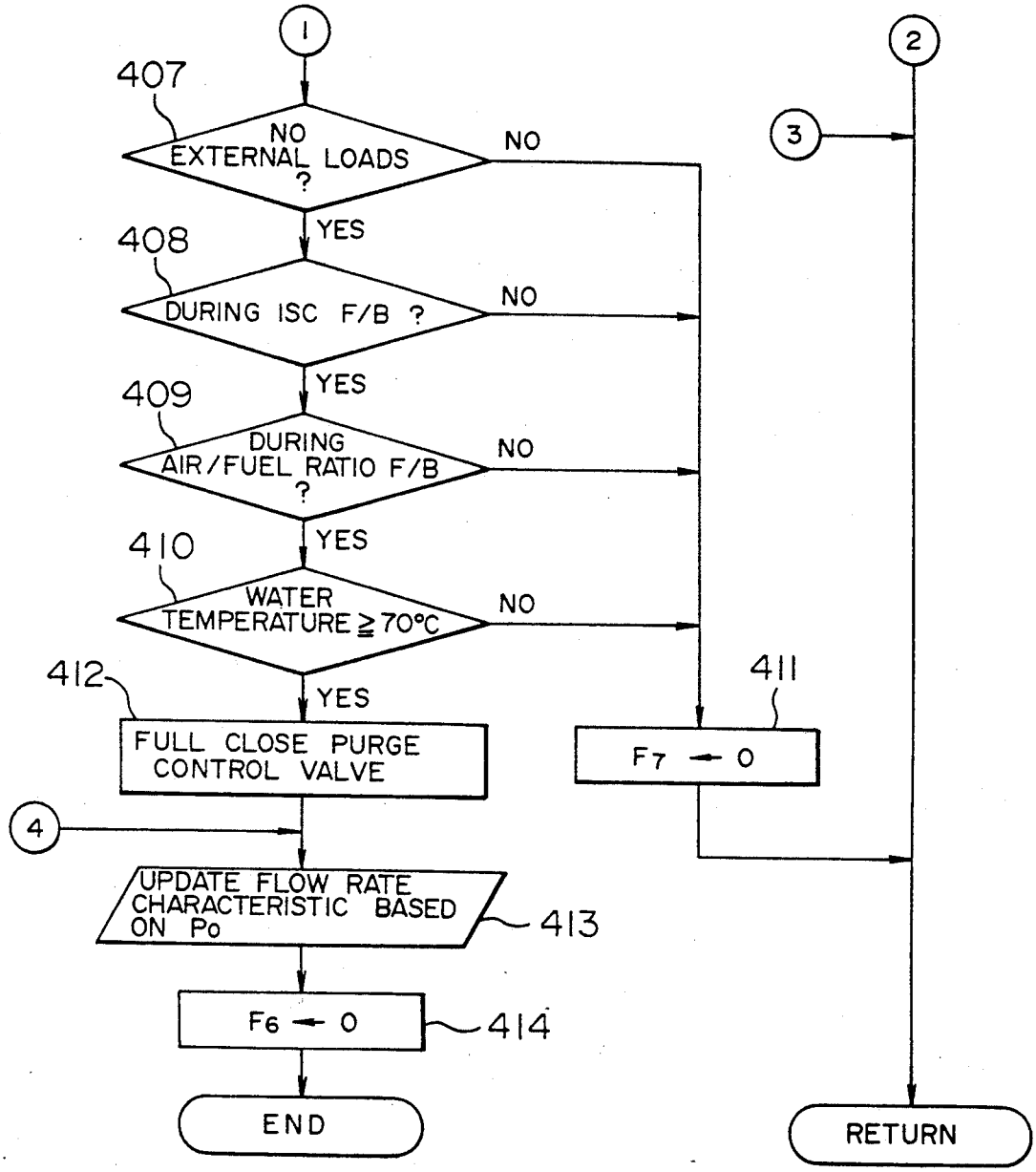
FIG. 14 is a flowchart for explaining operation.

FIGS. 13 and 14 show a purge control valve flow rate characteristic learning process routine executed once for a predetermined period of time. First, the CPU 26 determines in steps 400, 401 of FIG. 13 whether flags F7, F6 are set to "1" or not, respectively. At the beginning, F7, F6=0 holds because of the initialization and, therefore, the CPU 26 checks in a step 402 whether the flag F4 is F4=1 or not, thereby determining whether the purge control valve opening position P0 has been updated or not. If the purge control valve opening position P0 is not updated, then the process is returned to the first step 400 at once. If it is determined in the step 402 that the purge control valve opening position P0 has been updated, then the CPU 26 reads the purge control valve opening position P0 updated in the step 327 of FIG. 9, followed by setting the flag F6 to "1" in a step 404.

In a next step 405, the CPU 26 checks whether the flag F4 is F4=1 or not, thereby determining whether the abnormal detection process is being executed or not. If the abnormal detection process is being executed, then the CPU 26 sets the flag F7 to "1" in a step 406, followed by returning to the first step 400. In a next cycle of the process, F7=1 now holds in the step 400 and then the CPU 26 skips to the step 405 where if the abnormal detection process is not being executed, if determines in steps 407, 408, 409 and 410 of FIG. 14 whether the system is in a condition capable of executing the learning process. More specifically, the CPU 26 confirms in the step 407 that any external loads which may cause changes in the amount of intake air during the idling are not present, confirms in the step 408 that the target idling rotational speed control is being executed, confirms in the step 409 that the feedback control for controlling the air/fuel ratio to be held constant with the aid of the $O_2$ sensor 12 is being executed, and further determines in the step 410 whether the temperature of the engine cooling water is not lower than 70° C.

If any of the conditions of the steps 407, 408, 409 and 410 is not satisfied, then the CPU 26 sets the flag F7 to "0" in a step 411.

Figure 15:
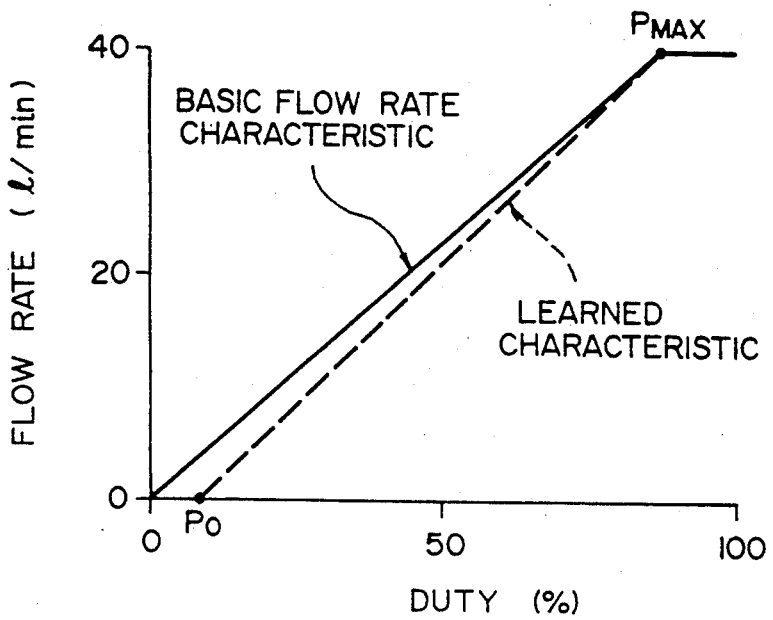
FIG. 15 is a graph showing one example of duty - flow rate characteristics of a purge control valve.

If the conditions capable of executing the learning process are all satisfied, then the CPU 26 sets the duty of the purge control valve 23 to 0% in a step 412 for making the same fully closed. In a next step 413, the flow rate characteristic of the purge control valve 23 is updated as indicated by a straight line connecting the duty of the read purge control valve opening position P0 and the duty of a maximum opening position PMAX, as shown in FIG. 15, following which the process is ended by setting the flag F6 to "0" in a step 414.

Figure 16:
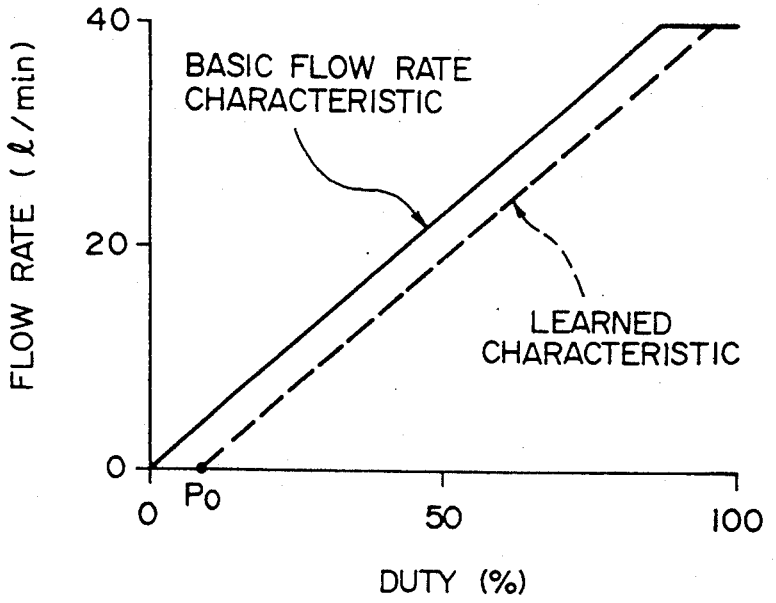
FIG. 16 is a graph showing another example of duty - flow rate characteristics of the purge control valve.
Figure 17:
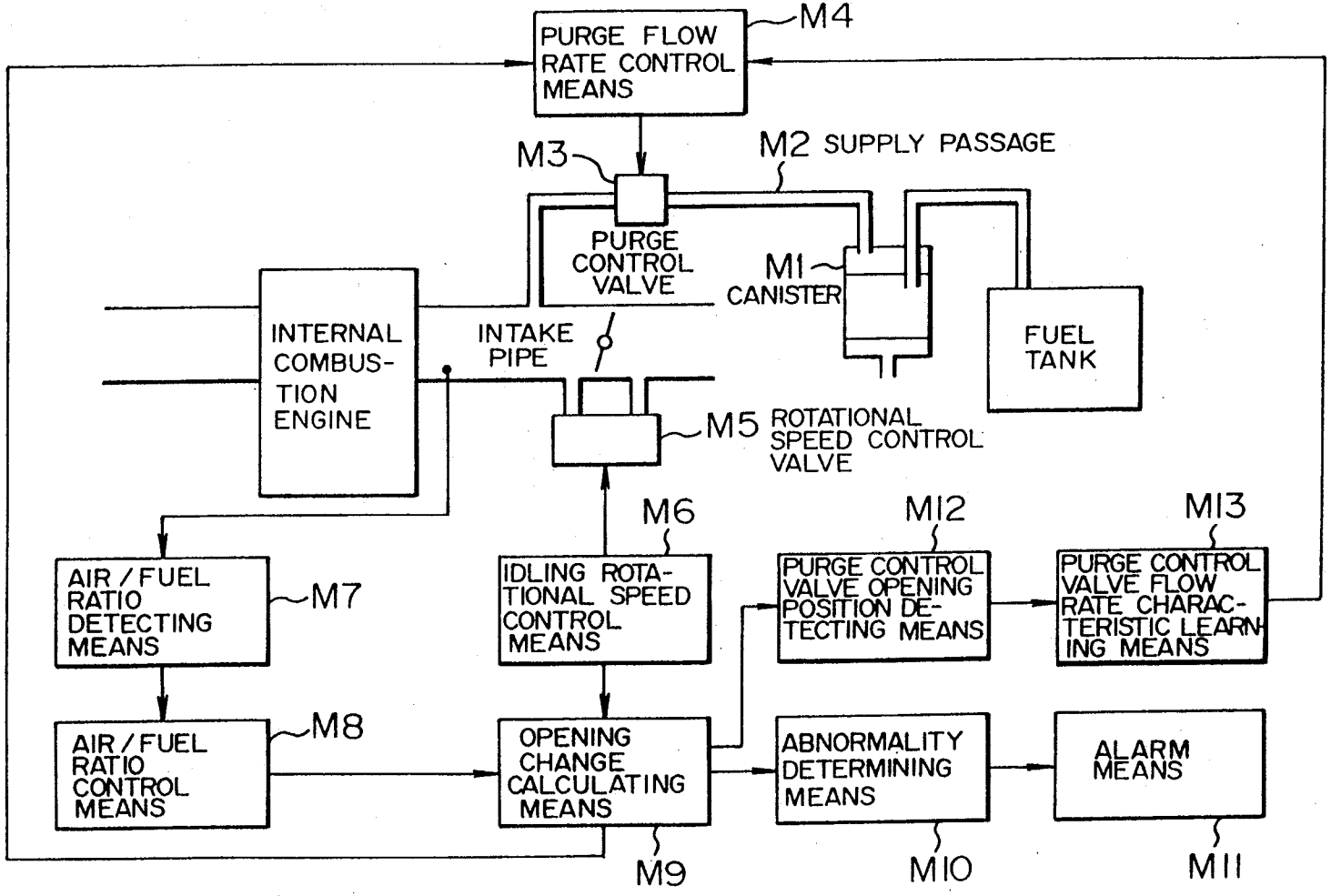
FIG. 17 is a block diagram showing the primary configuration of the, present invention.

In the step 413, the flow rate characteristic of the purge control valve 23 may be alternatively updated by translating the basic flow rate characteristic in parallel by a distance corresponding to the duty of the read purge control valve opening position P0, as shown in FIG. 16.

On the other hand, if the flag F6 is set to "1" in the step 401 of FIG. 13, meaning that the updated purge control valve opening position P0 has been read, then the CPU 26 checks whether the flag F1 is set to F1=1, thereby determining whether 5 seconds has elapsed after fully closing the purge control valve in the step 415. If 5 seconds has elapsed after fully closing the purge control valve and thus F1=1 is not set, then the process is returned, to the first step 400 at once. If 5 seconds has not elapsed after fully closing the purge control valve and thus F1=1 is set, then the CPU 26 goes to steps 413 and 414 of FIG. 14.

Based on the flow rate of the purge control valve 23 updated as mentioned above, the duty of the purge control valve 23 is controlled by the electronic control circuit 25 depending on engine operating condition such as the engine rotational speed and the engine load, so that the predetermined flow rate of purged air corresponding to the engine operating condition is obtained.

Thus, in this embodiment, the electronic control circuit 25 (i.e., the purged flow rate control means, the idling rotational speed control means, the air/fuel ratio control means, the opening change calculating means, the abnormality determining means, the purge control valve opening position detecting means, and the purge control valve flow rate characteristic learning means) operates such that the opening degree of the purge control valve 23 is regulated depending on the operating condition of the engine 1 to control the purged flow rate through the supply pipes 22, 24 (supply passage), the opening degree of the rotational speed control valve 8 is regulated to achieve the target rotational speed while the engine 1 is idling, thereby controlling the amount of intake air, and further the air/fuel ratio of the gas mixture supplied to the engine, which ratio is detected by the $O_2$ sensor 12 (the air/fuel ratio detecting means), is controlled to be held constant.

Also, the electronic control circuit 25 operates in such a manner as, under the air/fuel ratio control and the rotational speed control, to forcibly increase the duty of the purge control valve 23 gradually from the fully closed state (duty of 0%), determine the change $\Delta\theta$ in the opening degree of the rotational speed control valve 8 at that time, detect the duty value of the purge control valve 23 resulting when the change $\Delta\theta$ in the opening degree of the rotational speed control valve 8 exceeds a predetermined value set in advance, as the actual valve-opening position of the purge control valve 23, i.e., the zero point, and further update the flow rate characteristic of the purge control valve 23 based on the duty of the purge control valve 23 at that actual valve-opening position. As a result, variations in the flow rate characteristic of the purge control valve 23 can be corrected and controllability in the range of low flow rates which particularly requires accurate purge control can be improved, making it possible to prevent deterioration of exhaust emissions.

Further, the electronic control circuit 25 operates in such a manner as, under the air/fuel ratio control and the rotational speed control, to forcibly change the duty of the purge control valve 23 to the fully closed state (duty of 0%) and a predetermined opening state (duty of 20%), determine the change $\Delta\theta$ in the opening degree of the rotational speed control valve 8 at that time, and judge that an abnormality in supply of the fuel vapor to the intake pipe 2 has occurred due to an abnormality in at least one of the supply pipes 22, 24 and the purge control valve 23, if the change $\Delta\theta$ in the opening degree of the rotational speed control valve 8 is out of the preset allowable range (10 to 15%), followed by lighting up the alarm lamp 38 (the alarm means) to issue an alarm. Stated otherwise, while the purged flow rate is varied depending on changes in opening degree of the purge control valve 23 and thus the air/fuel ratio is varied, the air/fuel ratio is maintained constant at all times under the air/fuel ratio control and, therefore, the opening degree of the rotational speed control valve 8 under the idling rotational speed control is varied depending on changes in the purged flow rate through the purge control valve 23. Accordingly, changes in the opening degree of the rotational speed control valve 8 caused depending on changes in the opening degree of the purge control valve 23 represent changes in the purged flow rate through the purge control valve 23, enabling an abnormality to be detected based on the changes in the purged flow rate.

As a result, a failure in flow rate characteristics of the fuel vapor passage extending through the pipings 22, 24 connecting the canister 17 and the intake pipe 2, as well as the purge control valve 23 can be detected and thus a reduction in the purging ability of the purge system can be detected, without being affected by density of the fuel vapor purged from the canister 17 into the intake pipe 2.

Note that although in the foregoing embodiment, the opening degree of the purge control valve 23 is changed from the fully closed state to 20% and an abnormality in supply of the fuel vapor to the intake pipe 2 is determined from the change $\Delta\theta$ in the opening degree of the rotational speed control valve 8 at that time, the present invention is not limited to the illustrated embodiment. For example, such a supply abnormality may be determined from the above change $\Delta\theta$ resulting when the opening degree of the purge control valve 23 is changed from 5% to 25%, or 20% to the fully closed state.

Furthermore, the present invention can be variously modified without being limited to the above-mentioned embodiment. For example, while the idling rotational speed control is executed using the bypass air method in the illustrated embodiment, the same control may be performed by directly operating the throttle valve. The purge control valve 23 and the rotational speed control valve 8 are not limited to duty control valves and may be of any desired type of control valves, such as ones of stepping motor type and DC motor type, so long as the valves used can be continuously controlled in its opening degree. Additionally, while the alarm lamp 38 is used as the alarm means in the above embodiment, an alarm buzzer may be used as the alarm means to issue alarm sounds upon an abnormality being detected.

According to the present invention, as fully described above, there can be obtained the following superior advantages. The idling rotational speed control means which adjusts the amount of intake air into the internal combustion engine so that the target rotational speed is achieved during idling of the internal combustion engine, is effectively utilized to detect the condition of the purge control valve with certainty.

Also, the idling rotational speed control means which adjusts the amount of intake air into the internal combustion engine so that the target rotational speed is achieved during idling of the internal combustion engine, is effectively utilized to detect a failure in flow rate characteristics of pipings connecting the canister and the intake pipe, as well as the fuel gas supply passage in the purge control valve, without being affected by density of the fuel vapor purged from the canister to the intake pipe, thereby detecting a reduction in the purging ability of the purge system.

Furthermore, the idling rotational speed control means which adjusts the amount of intake air into the internal combustion engine so that the target rotational speed is achieved during idling of the internal combustion engine, is effectively utilized to learn the position at which the purge control valve opens, and correct variations in the valve-opening position thereby to prevent deterioration of exhaust emissions.

What is claimed is:

1. An internal combustion engine controller comprising:

a canister loaded with an absorbent to adsorb fuel vapor produced in a fuel tank containing liquid fuel, a supply passage for introducing the fuel vapor adsorbed by the adsorbent in said canister to an intake pipe of an internal combustion engine under an action of the negative pressure produced in said intake pipe, a purge control valve provided midway said supply passage and capable of adjusting its opening degree, means for adjusting the opening degree of said purge control valve depending on operating condition of said internal combustion engine to control a flow rate of the fuel vapor purged through said supply passage, a rotational speed control valve for adjusting an amount of intake, air into said internal combustion engine with adjustment of its opening degree to change a rotational speed of said internal combustion engine, means for adjusting the opening degree of said rotational speed control valve to control the amount of the intake air so that a target rotational speed is achieved during idling of said internal combustion engine, means for detecting an air/fuel ratio of a gas mixture supplied to said internal combustion engine, means for controlling the air/fuel ratio, detected by said air/fuel ratio detecting means, of the gas mixture supplied to said internal combustion engine to be held constant, and means for forcibly changing the opening degree of said purge control valve by said purge flow rate control means and calculating a change in the opening degree of said rotational speed control valve at that time under air/fuel ratio control by said air/fuel ratio control means and rotational speed control by said idling rotational speed control means.

2. An internal combustion engine controller comprising:

a canister loaded with an adsorbent to adsorb fuel vapor produced in a fuel tank containing liquid fuel, a supply passage for introducing the fuel vapor adsorbed by the adsorbent in said canister to an intake pipe of an internal combustion engine under an action of the negative pressure produced in said intake pipe, a purge control valve provided midway said supply passage and capable of adjusting its opening degree, means for adjusting the opening degree of said purge control valve depending on operating condition of said internal combustion engine to control a flow rate of the fuel vapor purged through said supply passage, a rotational speed control valve for adjusting an amount of intake air into said internal combustion engine with adjustment of its opening degree to change a rotational speed of said internal combustion engine, means for adjusting the opening degree of said rotational speed control valve to control the amount of the intake air so that a target rotational speed is achieved during idling of said internal combustion engine, means for detecting an air/fuel ratio of a gas mixture supplied to said internal combustion engine, means for controlling the air/fuel ratio, detected by said air/fuel ratio detecting means, of the gas mixture supplied to said internal combustion engine to be held constant, means for forcibly changing the opening degree of said purge control valve to a first set opening degree and a second set opening degree by said purge flow rate control means and calculating a change in the opening degree of said rotational speed control valve resulting when the opening degree of said purge control valve is changed from the first set opening degree to the second set opening degree, under air/fuel ratio control by said air/fuel ratio control means and rotational speed control by said idling rotational speed control means, means for determining that an abnormality in supply of the fuel vapor to said intake pipe has occurred due to an abnormality in at least one of said supply passage and said purge control valve, if the change in the opening degree of said rotational speed control valve derived by said opening change calculating means is out of a preset allowable range, and means for issuing an alarm when the presence of an abnormality is determined by said abnormality determining means.

3. An internal combustion engine controller comprising:

a canister loaded with an adsorbent to adsorb fuel vapor produced in a fuel tank containing liquid fuel, a supply passage for introducing the fuel vapor adsorbed by the adsorbent in said canister to an intake pipe of an internal combustion engine under an action of the negative pressure produced in said intake pipe, a purge control valve provided midway said supply passage and capable of adjusting its opening degree, means for adjusting the opening degree of said purge control valve depending on operating condition of said internal combustion engine to control a flow rate of the fuel vapor purged through said supply passage, a rotational speed control valve for adjusting an amount of intake air into said internal combustion engine with adjustment of its opening degree to change a rotational speed of said internal combustion engine, means for adjusting the opening degree of said rotational speed control valve to control the amount of the intake air so that a target rotational speed is achieved during idling of said internal combustion engine, means for detecting an air/fuel ratio of a gas mixture supplied to said internal combustion engine, means for controlling the air/fuel ratio, detected by said air/fuel ratio detecting means, of the gas mixture supplied to said internal combustion engine to be held constant, means for calculating a change in the opening degree of said rotational speed control valve resulting when said purge control valve is gradually opened from a fully closed state by said purge flow rate control means, under air/fuel ratio control by said air/fuel ratio control means and rotational speed control by said idling rotational speed control means, means for storing the opening degree of said purge control valve resulting when the change in the opening degree of said rotational speed control valve derived by said opening change calculating means exceeds a predetermined value set in advance, as a position at which said purge control valve actually begins to open, and means for learning a flow rate characteristic of said purge control valve depending on the opening position stored in said purge control valve opening degree storing means.

4. An internal combustion engine controller according to claim 3, further comprising:

means for determining that an abnormality in supply of the fuel vapor to said intake pipe has occurred due to an abnormality in at least one of said supply passage and said purge control valve, if the change in the opening degree of said rotational speed control valve derived by said opening change calculating means when the opening degree of said purge control valve is changed from a first set opening degree to a second set opening degree by said purge flow rate control means under air/fuel ratio control by said air/fuel ratio control means and rotational speed control by said idling rotational speed control means, is out of a preset allowable range, and means for issuing an alarm when the presence of an abnormality is determined by said abnormality determining means.

5. An internal combustion engine controller according to claim 1, wherein said purge control valve is a duty control valve with its opening degree controlled depending on a duty value.

6. An internal combustion engine controller according to claim 3, wherein said purge control valve flow rate characteristic learning means operates in such a manner as to update the flow rate characteristic of said purge control valve from a basic flow rate characteristic into a flow rate characteristic indicated by a straight line connecting the opening position of said purge control valve stored in said purge control valve opening degree storing means and a maximum opening position of said purge control valve.

7. An internal combustion engine controller according to claim 3, wherein said purge control valve flow rate characteristic learning means operates in such a manner as to update the flow rate characteristic of said purge control valve from a basic flow rate characteristic into a flow rate characteristic given by translating the basic flow rate characteristic in parallel by a distance corresponding to the opening position of said purge control valve stored in said purge control valve opening degree storing means.

8. An internal combustion engine controller according to claim 1, wherein said opening change calculating means includes means for storing the opening degree of said rotational speed control valve after a period of time enough, for the opening degree of said rotational speed control valve to change following a change in the opening degree of said purge control valve.

* * * * *